US007436248B2

(12) United States Patent
Furuichi

(10) Patent No.: US 7,436,248 B2
(45) Date of Patent: Oct. 14, 2008

(54) CIRCUIT FOR GENERATING IDENTICAL OUTPUT CURRENTS

(75) Inventor: Shuji Furuichi, Tokyo (JP)

(73) Assignee: Oki Electric Industry Co., Ltd. (JP)

( * ) Notice: Subject to any disclaimer, the term of this patent is extended or adjusted under 35 U.S.C. 154(b) by 225 days.

(21) Appl. No.: 11/406,460

(22) Filed: Apr. 19, 2006

(65) Prior Publication Data

US 2006/0261863 A1 Nov. 23, 2006

(30) Foreign Application Priority Data

May 6, 2005 (JP) ..... 2005-134938

(51) Int. Cl.
*G05F 1/10* (2006.01)

(52) U.S. Cl. ..... 327/543; 323/316

(58) Field of Classification Search ..... 327/530, 327/538, 540–543; 323/312–317
See application file for complete search history.

(56) References Cited

U.S. PATENT DOCUMENTS

| | | | | |
|---|---|---|---|---|
| 6,222,357 | B1 * | 4/2001 | Sakuragi | 323/315 |
| 6,323,631 | B1 * | 11/2001 | Juang | 323/315 |
| 6,332,661 | B1 | 12/2001 | Yamaguchi | |
| 6,353,402 | B1 * | 3/2002 | Kanamori | 341/118 |
| 6,693,388 | B2 * | 2/2004 | Oomura | 315/169.3 |
| 6,756,850 | B2 * | 6/2004 | Matsushita et al. | 330/285 |
| 6,897,717 | B1 * | 5/2005 | Eddleman et al. | 327/543 |
| 6,909,264 | B2 * | 6/2005 | Del Gatto et al. | 323/268 |
| 7,208,998 | B2 * | 4/2007 | Abel | 327/538 |
| 7,301,316 | B1 * | 11/2007 | Pham | 323/281 |
| 2002/0122308 | A1 * | 9/2002 | Ikeda | 362/259 |
| 2003/0184236 | A1 * | 10/2003 | Maede et al. | 315/169.1 |
| 2005/0030273 | A1 | 2/2005 | Shih et al. | |

FOREIGN PATENT DOCUMENTS

| | | |
|---|---|---|
| JP | 2000-293245 | 10/2000 |
| JP | 2005-056378 | 3/2005 |

* cited by examiner

*Primary Examiner*—Kenneth B. Wells
*Assistant Examiner*—Thomas J Hiltunen
(74) *Attorney, Agent, or Firm*—Studebaker & Brackett PC; Donald R. Studebaker

(57) ABSTRACT

A current driving circuit includes a bias voltage generator that generates a bias voltage and multiple constant current drivers that output driving currents. Each constant current driver includes first and second transistors coupled in series between two power supply potentials, and a third transistor that forms a current mirror with the second transistor. The control terminal of the first transistor receives the bias voltage. The control terminals of the second and third transistors are both connected to the node at which the first and second transistors are interconnected. This circuit configuration makes the output current, which is obtained from the third transistor, comparatively immune to fabrication process variations and variations in power-supply potentials.

6 Claims, 3 Drawing Sheets

CIRCUIT FOR GENERATING IDENTICAL OUTPUT CURRENTS

BACKGROUND OF THE INVENTION

1. Field of the Invention

The present invention relates to a circuit that outputs multiple currents to drive, for example, a current-driven display, and in particular to the reduction of differences between the multiple output currents.

2. Description of the Related Art

The circuit of interest supplies current to, for example, the driving electrodes of an organic electroluminescence (EL) display, also referred to as an organic light-emitting diode (OLED) display. A conventional circuit of this type, shown in FIG. 1, comprises a bias voltage generator 10 for generating a reference bias voltage VB corresponding to a reference current $I_{ref}$ and constant current drivers $\mathbf{20}_1$, $\mathbf{20}_2$, . . . , $\mathbf{20}_n$ that output driving currents OUT1, OUT2 , . . . , OUTn according to the bias voltage VB generated by the bias voltage generator 10.

The bias voltage generator 10 includes an operational amplifier (OP) 11, a p-channel metal-oxide-semiconductor (PMOS) transistor 12, and a resistor 13. The operational amplifier 11 receives the reference voltage VEL at its inverting input terminal, and has its non-inverting input terminal connected to a node N10. PMOS transistor 12 has its gate connected to the output terminal of the operational amplifier 11, its source connected to the power supply (VDD), and its drain connected to node N10. Node N10 is connected to ground (GND) through the resistor 13. A feedback loop operates so that PMOS transistor 12 conducts just enough current to make the potential of node N10 identical to the reference voltage VEL. This current is the reference current $I_{ref}$. A desired reference current $I_{ref}$ is obtained by using a resistor 13 with a resistance R equal to VEL/$I_{ref}$. The voltage applied to the gate of PMOS transistor 12 from the operational amplifier 11 is also the bias voltage VB The constant current drivers $\mathbf{20}_1$ to $\mathbf{20}_n$ have identical circuit configurations. Each constant current driver $\mathbf{20}_i$ (i=1 to n) includes a pair of PMOS transistors 21, 22 connected in series between the power supply (VDD) and a current output terminal. A display controller (not shown) supplies an input signal PWi, the pulse width of which is modulated, to the gate of PMOS transistor 21, in order to display different pixel intensities by controlling the duration of time for which driving current OUTi is supplied to the display. The bias voltage generator 10 supplies the bias voltage VB to the gate of PMOS transistor 22, so PMOS transistor 22 conducts a current proportional to the reference current $I_{ref}$. The substrates of both PMOS transistors 21, 22 are biased to the power supply potential VDD. In each constant current driver $\mathbf{20}_i$, when PMOS transistor 21 is switched on by the input signal PWi, PMOS transistor 22 outputs a driving current OUTi, proportional to the reference current $I_{ref}$, to the i-th driving electrode of the EL display, and an EL element in the EL display emits light with a brightness corresponding to the pulse width of the input signal PWi.

Further information can be found in Japanese Patent Application Publication No. 2000-293245.

Another current driving system is disclosed in Japanese Patent Application Publication No. 2005-56378. In this system, when a plurality of current drivers drive a display, in order to reduce differences between the output currents of the current drivers, each current driver includes a reference current generation unit and a current mirror unit, which operate according to a current adjustment parameter and a current-reproducing parameter. The reference current generation unit mirrors a reference input current to generate a reference output current, which is mirrored by the current mirror unit to generate the reference input current in the next current driver.

The following problems, however, have been found to occur in the conventional circuits described above.

It would be desirable to supply an identical power supply potential (VDD) to each constant current driver $\mathbf{20}_i$, but the flow of output current combines with the resistance on the power supply line from the power supply to the constant current driver $\mathbf{20}_i$ to cause a voltage drop that decreases the power supply potential actually received by the constant current driver $\mathbf{20}_i$. The further from the power supply the constant current driver $\mathbf{20}_i$ is, the greater the voltage drop becomes. Each constant current driver $\mathbf{20}_i$ accordingly receives a different VDD potential. When the VDD potential is lowered, the gate-source voltage Vgs of PMOS transistor 22 (also referred to below as the gate voltage Vg) is decreased, reducing the driving current OUTi.

A desirable property of a constant current driver is that the output driving current does not depend on the voltage of the current output terminal. PMOS transistor 22 is accordingly used in its saturation region, in which the drain current is nearly independent of the drain voltage. In normal transistor operation, if the gate voltage is increased, the linear region becomes wider, so the drain voltage at which the saturation region is entered becomes higher. The driver is therefore designed to operate at a comparatively low gate voltage Vg.

If the gate voltage Vg is set low in order to obtain a constant current characteristic, however, the decrease in the driving current when the power supply potential (VDD) is lowered becomes large. It is therefore difficult to reduce differences between the driving currents.

Variations in the threshold voltage Vt of PMOS transistor 22 in the constant current driver $\mathbf{20}_i$, which arise from fabrication process variations, also cause great differences in the driving currents OUTi.

SUMMARY OF THE INVENTION

An object of the present invention is to provide a current driving circuit that outputs identical currents from a plurality of constant current drivers despite fabrication process variations and voltage drops on the power supply line.

The invented current driving circuit includes a bias voltage generator and a plurality of constant current drivers, all receiving power at first and second potentials. The bias voltage generator receives a reference voltage, generates and outputs a bias voltage, and uses the bias voltage to regulate a reference current. The constant current drivers receive the bias voltage and output respective driving currents related to the reference current.

Each constant current driver includes a first node, a first transistor of one conductive type, and second and third transistors of another conductive type. The first main electrode of the first transistor receives the first potential. The first main electrodes of the second and third transistors receive the second potential. The control electrode of the first transistor receives the bias voltage. The control electrodes of the second and third transistors and the second main electrodes of the first and second transistors are connected to the first node. The second main electrode of the third transistor outputs one of the driving currents. Accordingly, the first and second transistors are coupled in series between the first and second potentials, and the second and third transistors form a current mirror.

The constant current driver may also have a switching transistor that supplies the second potential to the second and third transistors.

The bias voltage generator preferably has a similar circuit configuration with identical transistors, an additional resistor, and an operational amplifier. The output current of the bias voltage generator, which is the reference current, is supplied to a second node to which the resistor is connected. The resistor passes the output current to the first potential of the power supply. The operational amplifier receives the reference voltage and the potential of the second node, and generates the bias voltage.

The invented circuit configuration makes the output currents substantially immune to variations in the threshold voltage of the second and third transistors and variations in the potential of the node to which their control electrodes are connected, which may arise from fabrication process variations. This circuit configuration also permits the use of a comparatively high bias voltage, so that variations in the power supply potentials are small in comparison, making the output currents substantially immune to such variations, and in particular to the effect of voltage drops on the power supply line.

DETAILED DESCRIPTION OF THE INVENTION

Figure 1:
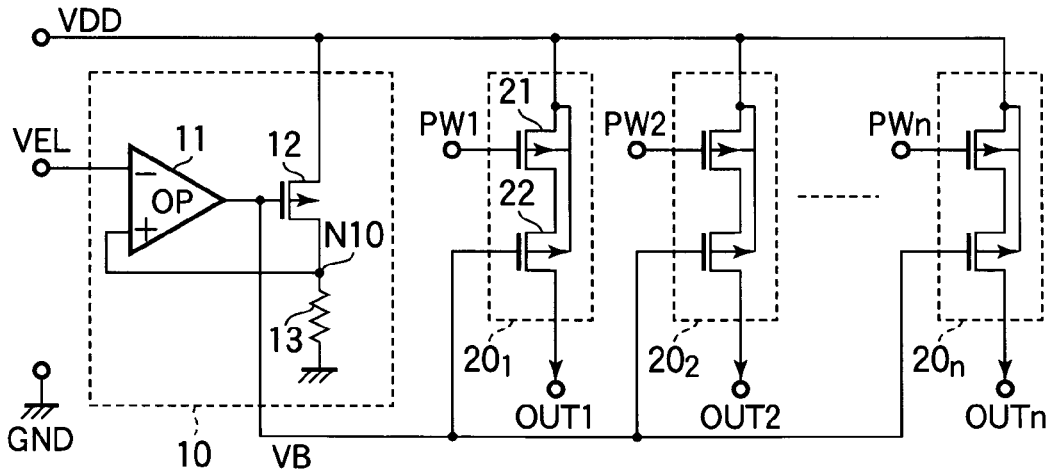
FIG. 1 PRIOR ART
FIG. 1 is a circuit diagram of a conventional current driving circuit.

Embodiments of the invention will now be described with reference to the attached drawings, in which like elements are indicated by like reference characters.

First Embodiment

Figure 2:
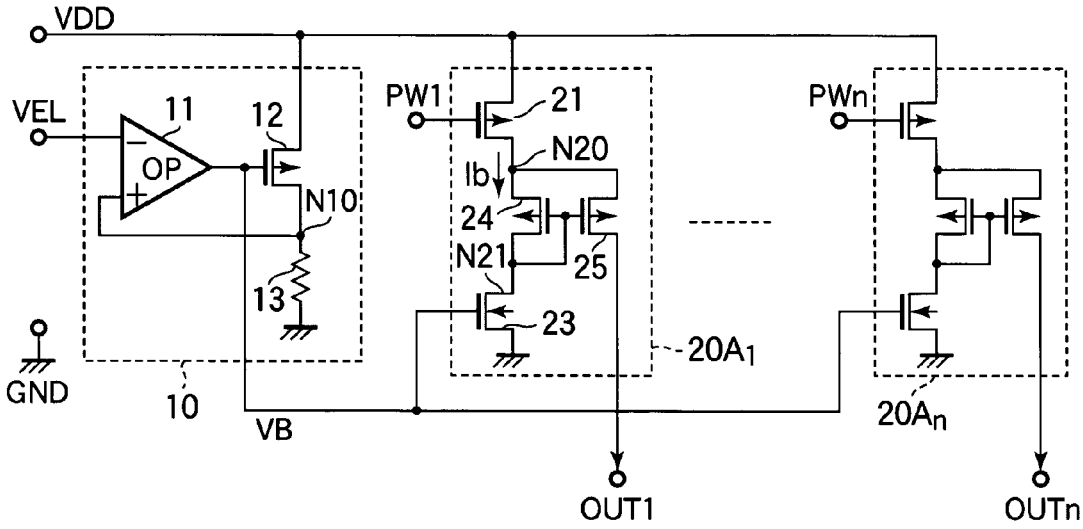
FIG. 2 is a circuit diagram of a current driving circuit illustrating a first embodiment of the invention.

Referring to FIG. 2, the first embodiment is a current driving current that supplies current for driving an organic EL display panel. The current driving circuit comprises a bias voltage generator 10 for generating a reference bias voltage VB corresponding to a reference current $I_{ref}$, and a plurality of constant current drivers 20$A_i$ for supplying driving currents OUTi (i=1 to n, where n is an integer greater than one) according to the bias voltage VB generated by the bias voltage generator 10.

The bias voltage generator 10 in the first embodiment has the same circuit configuration as the bias voltage generator 10 in the conventional current driving circuit in FIG. 1, including an operational amplifier 11, a PMOS transistor 12, and a resistor 13. The operational amplifier 11 receives the reference voltage VEL at its inverting input terminal, and has its non-inverting input terminal connected to a node N10. PMOS transistor 12 has its gate (control electrode) connected to the output terminal of the operational amplifier 11, its source (first main electrode) connected to the power supply to receive the VDD potential, and its drain (second main electrode) connected to node N10. Node N10 is connected to ground through the resistor 13. The voltage applied to the gate of PMOS transistor 12 from the operational amplifier 11 is supplied to the constant current drivers 20$A_i$ as the bias voltage VB.

The constant current drivers 20$A_i$ have identical circuit configurations. Each constant current driver 20$A_i$ includes PMOS transistors 21, 24, 25 and an n-channel metal-oxide-semiconductor (NMOS) transistor 23. PMOS transistor 21 is connected to the power supply (VDD) and a node N20, and is switched on and off by an input signal PWi. The input signal PWi is supplied from a display controller (not shown) in order to display different pixel intensities by controlling the duration of time for which driving current OUTi is supplied to the display.

NMOS transistor 23 has its main electrodes connected to ground and a node N21; PMOS transistor 24 has its main electrodes connected to node N21 and node N20. The gate of NMOS transistor 23 receives the bias voltage VB from the bias voltage generator 10. In all constant current drivers 20$A_i$ for which the input signal PWi is at the low logic level and PMOS transistor 21 is switched on, NMOS transistor 23 and PMOS transistor 21 conduct identical currents Ib, controlled by the bias voltage VB.

PMOS transistor 25 has its source connected to node N20, and its drain connected to a current output terminal for supplying the driving current OUTi. The gates of PMOS transistors 24, 25 are connected to node N21, so that PMOS transistors 24, 25 form a current mirror.

NMOS transistor 23 has comparatively low gain and operates at a comparatively high gate voltage Vg. PMOS transistor 25 has comparatively high gain, and operates at a comparatively low gate-source voltage Vg, so that its drain current is nearly independent of the drain voltage.

Next, the operation of the first embodiment will be described. It will be assumed that the power supply potential is twenty volts (VDD=20 V), the reference voltage VEL is five volts (5 V), the resistance R of the resistor 13 in the bias voltage generator 10 is one hundred sixty-seven kilohms (167 $k_n$), the reference current $I_{ref}$ is accordingly thirty microamperes (30 μA), and the current mirror ratio of PMOS transistors 24, 25 is one to ten (1:10).

Increasing the resistance R of resistor 13 has the effect of reducing the reference current $I_{ref}$, increasing the bias voltage VB, and increasing the current Ib conducted by NMOS transistor 23. Resistance R and the dimensions of transistors 12, 21, 23, and 24 can be selected so that $I_{ref}$ and Ib are substantially equal, and this will also be assumed.

In the bias voltage generator 10, when the inverting input terminal of the operational amplifier 11 receives the reference voltage VEL, as in the prior art, feedback operates to make the operational amplifier 11 generate a bias voltage VB that causes PMOS transistor 12 to conduct just enough reference current $I_{ref}$ to hold node N10 at the reference voltage VEL. The reference current $I_{ref}$ is thereby held constant, regardless of possible variations in the power supply potential VDD.

In each constant current driver 20$A_i$, when PMOS transistor 21 is switched on by the input signal PWi, NMOS transistor 23 conducts a current Ib controlled by the bias voltage VB supplied from the bias voltage generator 10 and therefore related to the reference current $I_{ref}$. This current Ib need not be large, which is why NMOS transistor 23 has a comparatively low gain.

The low gain of NMOS transistor 23 also permits the bias voltage VB to be set to a relatively high level, so that NMOS transistor 23 operates with a greater gate-source voltage Vgs than the small gate-source voltage that was necessary to produce saturation in the current driving transistor in the prior art.

The current Ib flowing through NMOS transistor 23 is supplied from the power supply (VDD) through PMOS transistors 21 and 24. If Vt indicates the threshold voltage and $\mu$ indicates the gain of PMOS transistor 24, then the relationship between the gate voltage Vg of PMOS transistor 24 and the current Ib is given by the equation below.

$$Ib=\beta\times(Vg-Vt)^2/2$$

The gate voltage Vg of PMOS transistor 24 in this equation is also applied to the gate of PMOS transistor 25. If the gain of PMOS transistor 25 is N times the gain of PMOS transistor 24, the gain of PMOS transistor 25 is equal to the product N×β. The driving current OUT flowing through PMOS transistor 25 is accordingly indicated by the equation below (OUT represents any of the output currents OUT1 to OUTn indicated in FIG. 2).

$$\begin{aligned}\mathrm{OUT} &= N\times\beta\times(Vg-Vt)^2/2\\ &= N\times Ib\end{aligned}$$

In the physical layout of the circuit, PMOS transistors 24 and 25 are mutually adjacent, so their gate voltage Vg and threshold voltage Vt do not differ within the same constant current driver 20$A_i$, even if they vary from one constant current driver to another. Under the assumptions given above, N is equal to ten (N=10) and the driving current OUT is 300 μA, being N times the reference current $I_{ref}$.

The first embodiment therefore makes the driving currents supplied from the constant current drivers 20$A_i$ immune to variations in the gate voltage Vg and the threshold voltage Vt of PMOS transistors 24, 25.

The driving currents are also immune to the effects of resistive voltage drops on the power supply (VDD) line, because these VDD voltage drops do not alter the gate-source voltage of the NMOS transistors 23, which is equal to the difference between the bias voltage VB and ground.

No resistive voltage drops occur on the VB signal line because, as the gates of the NMOS transistors 23 are capacitive loads, no current flows on the VB signal line. Provided the ground potential is uniform, all of the NMOS transistors 23 can be expected to operate with identical gate-source voltages. Moreover, the effect of such non-uniformities as may occur in the ground potential is reduced by the comparatively high value of the bias voltage VB, which makes the variations small in comparison with the gate-source voltage Vg.

The first embodiment accordingly has the following effects:

(1) Differences between the output currents OUTi (i=1 to n) due to voltage drops on the power supply VDD line, and to other variations in the power supply potentials, are reduced.

(2) Differences between the output currents OUTi due to transistor threshold voltage differences arising from fabrication process variations are reduced.

Second Embodiment

Figure 3:
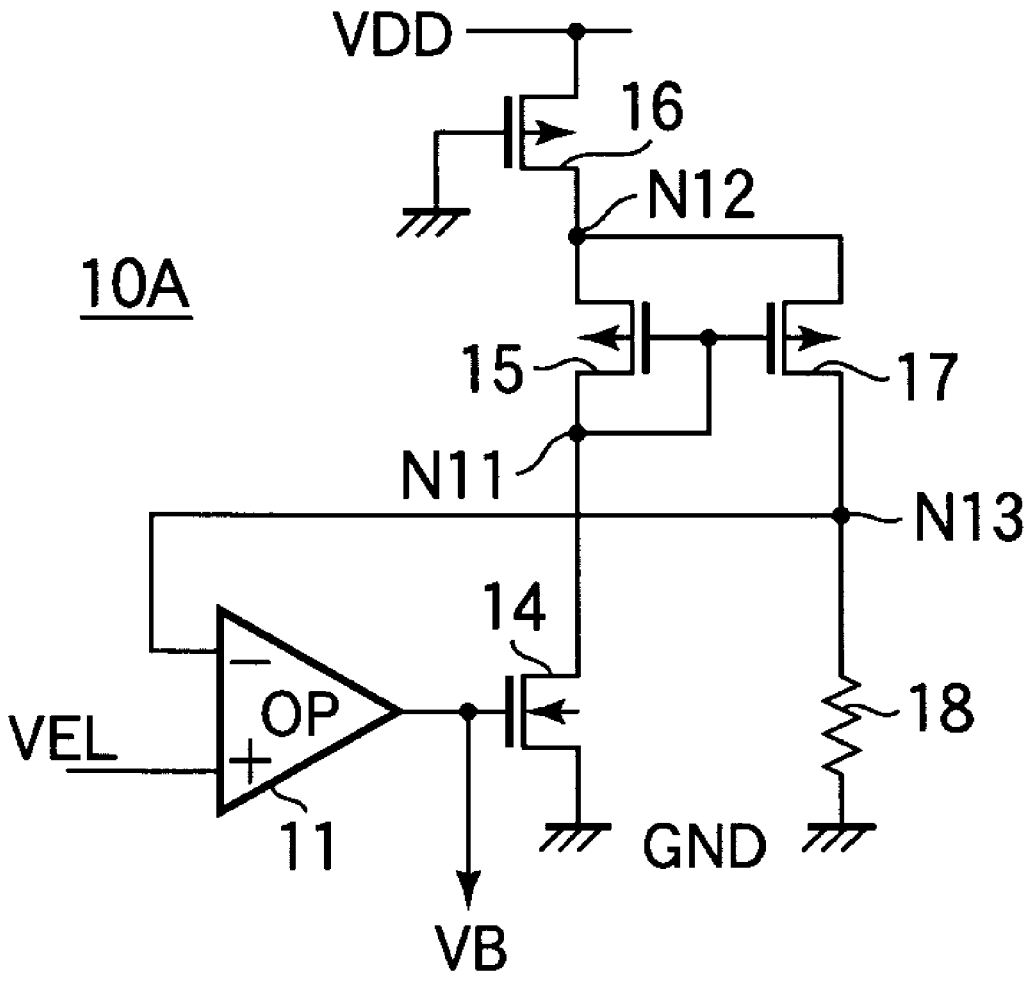
FIG. 3 is a circuit diagram of a bias voltage generator used in a second embodiment of the invention.

Referring to FIG. 3, the second embodiment differs from the first embodiment by having a different bias voltage generator 10A.

The bias voltage generator 10A includes an operational amplifier 11, PMOS transistors 15, 16, 17, an NMOS transistor 14, and a resistor 18. The operational amplifier 11 receives the reference voltage VEL at its non-inverting input terminal, and has its inverting input terminal connected to a node N13. NMOS transistor 14 has its gate connected to the output terminal of the operational amplifier 11, its source connected to ground, and its drain connected to a node N11. PMOS transistor 15 has its drain connected to node N11 and its source connected to a node N12. Node N12 is connected to the VDD potential through PMOS transistor 16, which has its gate connected to ground and is permanently switched on.

Node N12 is also connected to node N13 through PMOS transistor 17, and node N13 is connected to ground through the resistor 18. The gates of PMOS transistors 15 and 17 are connected to node N11, so that PMOS transistors 15 and 17 form a current mirror. The four transistors 14, 15, 16, 17 are interconnected in the same way as the corresponding four transistors 23, 24, 21, 25 in each of the constant current drivers 20$A_i$ in FIG. 2. NMOS transistors 14 and 23 have mutually identical dimensions and are formed simultaneously under identical processing conditions, and both receive the bias voltage VB at their gates. PMOS transistors 15, 24 have mutually identical dimensions, PMOS transistors 16, 21 have mutually identical dimensions, and PMOS transistors 17, 25 have mutually identical dimensions, and all of these PMOS transistors are formed simultaneously under identical processing conditions.

Next, the operation of the bias voltage generator 10A will be described.

If the gate voltage (bias voltage VB) of NMOS transistor 14 increases, the current flowing through NMOS transistor 14 and PMOS transistor 15 increases. As the current flowing through PMOS transistor 15 increases, the current flowing through PMOS transistor 17, which forms a current mirror with PMOS transistor 15, increases proportionately.

As the current flowing through PMOS transistor 17 increases, the voltage drop in the resistor 18 that is connected in series with PMOS transistor 17 becomes greater, and the potential of node N13 increases. Since node N13 is connected to the inverting input terminal of the operational amplifier 11, the output voltage (that is, bias voltage VB) of the operational amplifier 11 decreases.

Because of this feedback loop, the potential of the inverting input terminal of the operational amplifier 11 (that is, the potential of node N13) is held substantially equal to the reference voltage VEL input at the non-inverting input terminal of the operational amplifier 11. The current that produces this potential at node N13 is the reference current $I_{ref}$. A desired reference current $I_{ref}$ is obtained by using a resistor 18 with a resistance R equal to VEL/$I_{ref}$. The voltage supplied from the operational amplifier 11 is also the bias voltage VB. The constant current drivers 20$A_i$ that receive the bias voltage VB from the bias voltage generator 10A have the same circuit configuration as the corresponding part of the bias voltage generator 10A and are formed simultaneously under the same processing conditions. Each constant current driver that is switched on therefore drives the same current through PMOS transistor 25 as flows through PMOS transistor 17 in the bias voltage generator 10A. Accordingly, the driving current OUTi supplied from each turned-on constant current driver 20$A_i$ is equal to the reference current $I_{ref}$.

In addition to the effects of the first embodiment, the second embodiment has the effect that the reference current $I_{ref}$ supplied from the bias voltage generator 10A is identical to the driving current OUTi supplied from each constant current driver 20$A_i$, which simplifies the circuit design process.

Further Variations

The above embodiments can be modified in various ways, such as, for example, the following.

(1) The reference current $I_{ref}$ and the resistance of the resistor 13 need not have the exemplary values mentioned in the first embodiment. Those values are suitable for an application in which the first embodiment is used to drive a specific type of organic EL display, but the invented current driving circuit can be used to supply identical driving currents to any type of display or, more generally, to any plurality of driven circuits.

(2) The PMOS transistor 21 used as an on-off switch in each constant current driver 20$A_i$ is unnecessary if the driving current OUTi is supplied continuously. If these PMOS transistors 21 are eliminated, PMOS transistor 16 in FIG. 3 may also be eliminated.

(3) The circuit configuration of the bias voltage generator 10 in the first embodiment may be modified in various ways other than that shown in the second embodiment.

(4) The direction of output current flow may be reversed if PMOS transistors are replaced with NMOS transistors, NMOS transistors are replaced with PMOS transistors, and the roles of VDD and ground are interchanged.

Those skilled in the art will recognize that further variations are possible within the scope of the invention, which is defined in the appended claims.

What is claimed is:

1. A current driving circuit supplied with power having a first potential and a second potential and receiving a reference voltage, the current driving circuit having a bias voltage generator and a plurality of constant current drivers, the bias voltage generator receiving the reference voltage, generating a bias voltage, and using the bias voltage to regulate a reference current, the constant current drivers receiving the bias voltage and outputting driving currents related to the reference current, wherein each constant current driver comprises:

a first node;

a first transistor of a first conductive type, having a first main electrode receiving the first potential, a second main electrode connected to the first node, and a control terminal receiving the bias voltage;

a second transistor of a second conductive type, having a first main electrode receiving the second potential, a second main electrode connected to the first node, and a control terminal connected to the first node; and a third transistor of the second conductive type, having a first main electrode receiving the second potential, a second main electrode outputting one of the driving currents, and a control terminal connected to the first node, wherein the bias voltage generator comprises:

a second node;

a third node;

an operational amplifier having a non-inverting input terminal receiving the reference voltage, an inverting input terminal connected to the second node, and an output terminal outputting the bias voltage;

a fourth transistor of the first conductive type, having a first main electrode receiving the first potential, a second main electrode connected to the third node, and a control terminal connected to the output terminal of the operational amplifier;

a fifth transistor of the second conduetive type, having a first main electrode receiving the second potential, a second main electrode connected to the third node, and a control terminal connected to the third node;

a sixth transistor of the first conductive type, having a first main electrode receiving the second potential, a second main electrode connected to the second node, and a control terminal connected to the third node; and a resistor having one terminal connected to the second node and another terminal receiving the first potential.

2. The current driving circuit of claim 1, wherein the first and fourth transistors have mutually identical dimensions and are formed simultaneously under identical processing conditions, the second and fifth transistors have mutually identical dimensions, the third and sixth transistors have mutually identical dimensions, and the second, third, fifth, and sixth transistors are formed simultaneously under identical processing conditions.

3. The current driving circuit of claim 1, wherein the bias voltage generator further comprises a seventh transistor of the second conductive type for supplying the second potential to the fifth and sixth transistors, the seventh transistor having a first main electrode receiving the second potential, a second main electrode connected to the first main electrodes of the fifth and sixth transistors, and a control electrode receiving the first potential.

4. The current driving circuit of claim 1, wherein the fourth, fifth, and sixth transistors are field-effect transistors.

5. The current driving circuit of claim 4, wherein the fourth transistor is an NMOS transistor, and the fifth and sixth transistors are PMOS transistors.

6. The current driving circuit of claim 4, wherein the fourth transistor is a PMOS transistor, and the fifth and sixth transistors are NMOS transistors.

* * * * *